US005881388A

United States Patent [19]

Pratt

[11] Patent Number: 5,881,388

[45] Date of Patent: Mar. 16, 1999

[54] GLOVE WITH FINGER GRIP INSERTS

[76] Inventor: Kevin G. Pratt, 22 Magnesium St., Henderson, Nev. 89015

[21] Appl. No.: 55,948

[22] Filed: Apr. 6, 1998

[51] Int. Cl.[6] ..... A41D 19/00

[52] U.S. Cl. ..... 2/163; 2/159; 2/21

[58] Field of Search ..... 2/21, 163, 161.7, 2/161.1, 161.6, 16, 159, 160

[56] References Cited

U.S. PATENT DOCUMENTS

| | | | |
|---|---|---|---|
| 617,929 | 1/1899 | Fowble | 2/21 |
| 1,755,014 | 4/1930 | Morrison | 2/21 |
| 2,070,506 | 2/1937 | Bevill | 2/21 |
| 2,129,496 | 9/1938 | Hollingsworth | 2/21 |
| 3,119,118 | 1/1964 | Beebe | 2/162 |
| 4,507,807 | 4/1985 | Karkanen | 2/21 |
| 4,519,097 | 5/1985 | Chappell, Jr. et al. | 2/16 |
| 4,681,012 | 7/1987 | Stelma et al. | 2/163 |
| 4,694,508 | 9/1987 | Iriyama et al. | 2/21 |
| 4,894,866 | 1/1990 | Walker | 2/161 R |
| 4,942,626 | 7/1990 | Stern et al. | 2/21 |
| 4,995,119 | 2/1991 | Codkind | 2/163 |
| 5,093,933 | 3/1992 | Berry | 2/163 |
| 5,390,371 | 2/1995 | Sigward | 2/159 |
| 5,561,856 | 10/1996 | Pesco | 2/21 |
| 5,659,899 | 8/1997 | Soter et al. | 2/162 |
| 5,675,839 | 10/1997 | Gordon et al. | 2/159 |
| 5,680,654 | 10/1997 | McClanahan | 2/163 |

*Primary Examiner*—Amy Vanatta
*Attorney, Agent, or Firm*—Joseph N. Breaux

[57] ABSTRACT

A lightweight glove having finger grip inserts for use by persons playing slot machines or the like that includes a light weight fabric glove shell having an elastic wrist band and insert receiving ends formed into the thumb and index fingers thereof and two resilient elastomeric finger grip inserts one secured to each of the insert receiving ends of the thumb and index finger portions of the glove shell. Each of the resilient elastomeric finger grip inserts includes a lower coin contact area for receiving the tip of the users finger, a U-shaped glove finger top attachment portion formed integrally with and adjacent to the perimeter edge of the lower coin contact area, a glove finger attachment edge, a contact area biasing strip integrally formed between the two parallel portions of the U-shaped glove finger top attachment portion, and a moisture vent opening defined by the contact area biasing strip and the U-shaped glove finger top attachment portion. Each of the insert receiving ends of the glove shell includes a finger covering portion terminating in a tubular end opening sized for receiving the glove finger attachment edge of the resilient elastomeric finger grip insert therein and a finger top attachment tab extending from and formed integrally with the top of the finger covering portion. The finger top attachment tab is sized to fit over the U-shaped glove finger top attachment portion and in registration with the perimeter edge of the lower coin contact area.

3 Claims, 2 Drawing Sheets

GLOVE WITH FINGER GRIP INSERTS

TECHNICAL FIELD

The present invention relates to gloves and more particularly to a lightweight glove having finger grip inserts for use by persons playing slot machines or the like that includes a light weight fabric glove shell having an elastic wrist band and insert receiving ends formed into the thumb and index fingers thereof and two resilient elastomeric finger grip inserts one secured to each of the insert receiving ends of the thumb and index finger portions of the glove shell; each of the resilient elastomeric finger grip inserts including a lower coin contact area for receiving the tip of the users finger, a U-shaped glove finger top attachment portion formed integrally with and adjacent to the perimeter edge of the lower coin contact area, a glove finger attachment edge, a contact area biasing strip integrally formed between the two parallel portions of the U-shaped glove finger top attachment portion, and a moisture vent opening defined by the contact area biasing strip and the U-shaped glove finger top attachment portion; each of the insert receiving ends of the glove shell including a finger covering portion terminating in a tubular end opening sized for receiving the glove finger attachment edge of the resilient elastomeric finger grip insert therein and a finger top attachment tab extending from and formed integrally with the top of the finger covering portion; the finger top attachment tab being sized to fit over the U-shaped glove finger top attachment portion and in registration with the perimeter edge of the lower coin contact area of the resilient elastomeric finger grip insert.

BACKGROUND ART

Players of coin operated amusement and gambling devices such as slot machines must often contact thousands of coins during a playing session. Because the coins contact numerous other individuals and because the coins can transmit dirt and contaminants between players. It would be a benefit to such players to have a glove that could be worn while playing to protect the hands and fingers from contamination. Because picking up coins can be difficult when wearing gloves it would be a further benefit to have a glove that included resilient elastomeric portions on the thumb and index finger to aid in lifting coins. Because resilient elastomeric materials can prevent moisture from passing therethrough it would be a further benefit if the resilient elastomeric portions on the thumb and index finger included a moisture vent opening to assist in removing moisture accumulation between the wearer's finger tips and the resilient elastomeric portions.

GENERAL SUMMARY DISCUSSION OF INVENTION

It is thus an object of the invention to provide a glove with finger grip inserts for use by players of coin operated amusement and gambling devices such as slot machines.

It is a further object of the invention to provide a glove with finger grip inserts that includes a lightweight fabric glove shell.

It is a still further object of the invention to provide a glove with finger grip inserts that are secured to the thumb and index finger.

It is a still further object of the invention to provide a glove with finger grip inserts that each include a moisture vent opening to assist in removing moisture accumulation between the wearer's finger tips and the resilient elastomeric finger grip insert.

It is a still further object of the invention to provide a glove with finger grip inserts that includes a light weight fabric glove shell having an elastic wrist band and insert receiving ends formed into the thumb and index fingers thereof and two resilient elastomeric finger grip inserts one secured to each of the insert receiving ends of the thumb and index finger portions of the glove shell; each of the resilient elastomeric finger grip inserts including a lower coin contact area for receiving the tip of the users finger, a U-shaped glove finger top attachment portion formed integrally with and adjacent to the perimeter edge of the lower coin contact area, a glove finger attachment edge, a contact area biasing strip integrally formed between the two parallel portions of the U-shaped glove finger top attachment portion, and a moisture vent opening defined by the contact area biasing strip and the U-shaped glove finger top attachment portion; each of the insert receiving ends of the glove shell including a finger covering portion terminating in a tubular end opening sized for receiving the glove finger attachment edge of the resilient elastomeric finger grip insert therein and a finger top attachment tab extending from and formed integrally with the top of the finger covering portion; the finger top attachment tab being sized to fit over the U-shaped glove finger top attachment portion and in registration with the perimeter edge of the lower coin contact area of the resilient elastomeric finger grip insert.

It is a still further object of the invention to provide a glove with finger grip inserts that accomplishes some or all of the above objects in combination.

Accordingly, a glove with finger grip inserts is provided. The glove with finger grip inserts includes a light weight fabric glove shell having an elastic wrist band and insert receiving ends formed into the thumb and index fingers thereof and two resilient elastomeric finger grip inserts one secured to each of the insert receiving ends of the thumb and index finger portions of the glove shell; each of the resilient elastomeric finger grip inserts including a lower coin contact area for receiving the tip of the users finger, a U-shaped glove finger top attachment portion formed integrally with and adjacent to the perimeter edge of the lower coin contact area, a glove finger attachment edge, a contact area biasing strip integrally formed between the two parallel portions of the U-shaped glove finger top attachment portion, and a moisture vent opening defined by the contact area biasing strip and the U-shaped glove finger top attachment portion; each of the insert receiving ends of the glove shell including a finger covering portion terminating in a tubular end opening sized for receiving the glove finger attachment edge of the resilient elastomeric finger grip insert therein and a finger top attachment tab extending from and formed integrally with the top of the finger covering portion; the finger top attachment tab being sized to fit over the U-shaped glove finger top attachment portion and in registration with the perimeter edge of the lower coin contact area of the resilient elastomeric finger grip insert.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
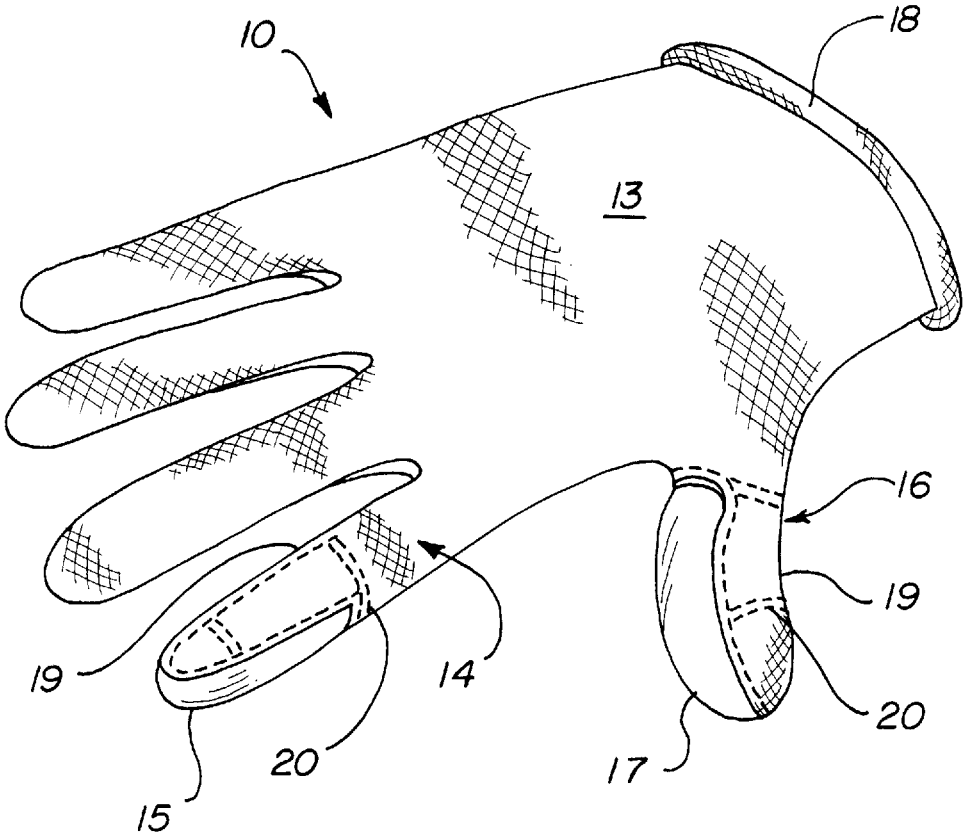
FIG. 1 is a perspective view of an exemplary embodiment of the glove with finger grip inserts of the present invention showing the light weight fabric glove shell, the elastomeric wrist band, and the two resilient elastomeric finger grip inserts one stitched to each of the insert receiving ends of the thumb and index finger portions of the glove shell.

FIG. 1 shows an exemplary embodiment of the glove with finger grip inserts of the present invention, generally designated by the numeral 10. Glove with finger grip inserts 10 includes a light weight fabric glove shell 12 and first and second resilient elastomeric finger grip inserts 15,17. Glove shell 12 is constructed of breathable, cotton fabric and includes a palm portion 13 having an index finger portion 14, a thumb portion 16, and an elastomeric wrist band 18. In this embodiment first and second resilient elastomeric finger grip inserts 15,17 are secured to the insert receiving ends 19 of index finger portion 14 and thumb portion 16, respectively, by stitching with thread 20. Although stitching is used in this embodiment, other securing mechanisms such as adhesives can be used without departing in any manner from the spirit and scope of the invention taught herein.

Figure 2:
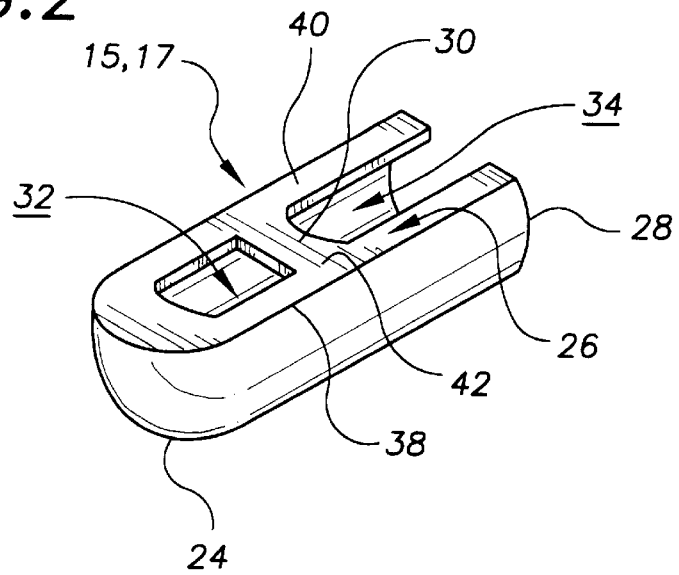
FIG. 2 is a perspective view of one of the identical resilient elastomeric finger grip inserts in isolation showing the lower coin contact area, the glove finger top attachment portion, the glove finger attachment edge, the contact area biasing strip, and the moisture vent opening.

With reference to FIG. 2, first and second resilient elastomeric finger grip inserts, 15,17 are of identical molded plastic construction. Each finger grip insert 15,17 includes a lower coin contact area 24; a U-shaped glove finger top attachment portion, generally designated 26; a glove finger attachment edge 28; a contact area biasing strip 30; and a moisture vent opening 32. Lower coin contact area 24 is contoured to form a finger tip receiving channel 34 running the entire length of lower coin contact area 24. U-shaped glove finger top attachment portion 26 is formed integrally with and adjacent to a perimeter edge 38 of lower coin contact area 24. Contact area biasing strip 30 is integrally formed between two parallel portions 4042 of U-shaped glove finger top attachment portion 26. In use, contact biasing strip 30 serves to pull lower coin contact area 24 against the finger pads of the user and prevent slippage between the finger pads and lower coin contact area 24. Moisture vent opening 32 is defined by contact area biasing strip 32 and U-shaped glove finger top attachment portion 26. Moisture vent opening 32 provides an opening through which moisture from the finger pad area of the wearer can be vented.

Figure 3:
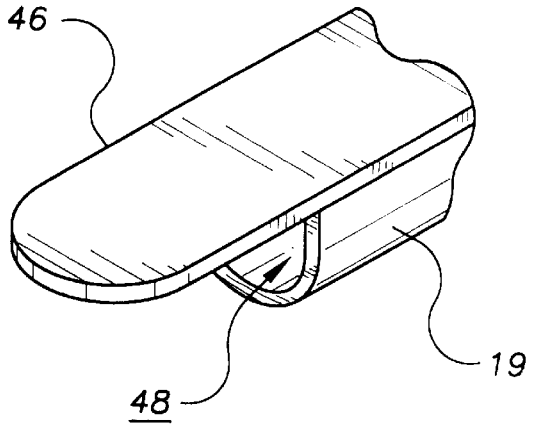
FIG. 3 is a perspective view of one of the insert receiving ends of the glove shell of FIG. 1 showing the finger top attachment tab that is securable to the glove finger top attachment portion and the contact area biasing strip of the resilient elastomeric finger grip insert; and the tubular end opening for receiving the glove finger attachment edge of the resilient elastomeric finger grip insert.
Figure 4:
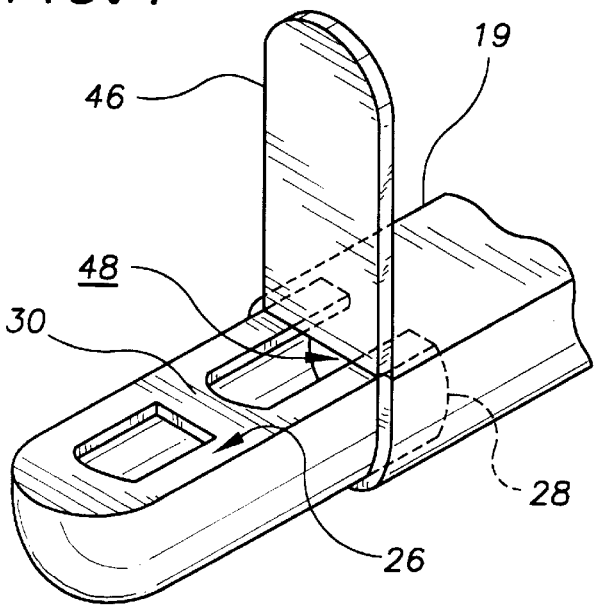
FIG. 4 is a perspective view showing the glove finger attachment edge of the resilient elastomeric finger grip insert inserted into the tubular end opening of the insert receiving end of one of the glove shell fingers and the finger top attachment tab folded upwardly to show the glove finger top attachment portion and the contact area biasing strip of the resilient elastomeric finger grip insert.

With reference to FIG. 3, each insert receiving end 19 of glove shell 13 (FIG. 1) includes a finger top attachment tab 46 that is securable to glove finger top attachment portion 26 (FIG. 2) and contact area biasing strip 30 (FIG. 2) of resilient elastomeric finger grip insert 15,17, (FIG. 2); and a tubular end opening 48 for receiving glove finger attachment edge 28 (FIG. 2) of resilient elastomeric finger grip insert 15,17, (FIG. 2). With reference to FIG. 4, during assembly, glove finger attachment edge of resilient elastomeric finger grip insert 15,17 is inserted into tubular end opening of insert receiving end 19. Finger top attachment tab 46 is then folded down onto glove finger top attachment portion 26 and contact area biasing strip 30 prior to cementing or stitching the two together.

It can be seen from the preceding description that a glove with finger grip inserts has been provided that includes a lightweight fabric glove shell; that includes finger grip inserts that are secured to the thumb and index finger; that includes finger grip inserts that each include a moisture vent opening to assist in removing moisture accumulation between the wearer's finger tips and the resilient elastomeric finger grip insert; and that includes a light weight fabric glove shell having an elastic wrist band and insert receiving ends formed into the thumb and index fingers thereof and two resilient elastomeric finger grip inserts one secured to each of the insert receiving ends of the thumb and index finger portions of the glove shell; each of the resilient elastomeric finger grip inserts including a lower coin contact area for receiving the tip of the users finger, a U-shaped glove finger top attachment portion formed integrally with and adjacent to the perimeter edge of the lower coin contact area, a glove finger attachment edge, and a contact area biasing strip integrally formed between the two parallel portions of the U-shaped glove finger top attachment portion; each of the insert receiving ends of the glove shell including a finger covering portion terminating in a tubular end opening sized for receiving the glove finger attachment edge of the resilient elastomeric finger grip insert therein and a finger top attachment tab extending from and formed integrally with the top of the finger covering portion; the finger top attachment tab being sized to fit over the U-shaped glove finger top attachment portion and in registration with the perimeter edge of the lower coin contact area of the resilient elastomeric finger grip insert.

It is noted that the embodiment of the glove with finger grip inserts described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A glove with finger grip inserts comprising:

a fabric glove shell having a first resilient elastomeric finger grip insert secured to a thumb portion thereof and a second resilient elastomeric finger grip insert secured to an index finger portion thereof;

said fabric glove shell including insert receiving ends formed into a thumb and an index finger portion thereof;

each of said resilient elastomeric finger grip inserts including a lower coin contact area for receiving a tip of a user's finger, a U-shaped glove finger top attachment portion formed integrally with and adjacent to a perimeter edge of said lower coin contact area, a glove finger attachment edge, a contact area biasing strip integrally formed between two parallel portions of said U-shaped glove finger top attachment portion, and a moisture vent opening defined by said contact area biasing strip and said U-shaped glove finger top attachment portion; and each of said insert receiving ends of said glove shell including a finger covering portion terminating in a tubular end opening sized for receiving said glove finger attachment edge of said resilient elastomeric finger grip insert therein and a finger top attachment tab extending from and formed integrally with a top of said finger covering portion;

said finger top attachment tab being sized to fit over said U-shaped glove finger top attachment portion and in registration with said perimeter edge of said lower coin contact area of said resilient elastomeric finger grip insert.

2. A glove with finger grip inserts comprising:

a fabric glove shell having a first resilient elastomeric finger grip insert secured to a thumb portion thereof and a second resilient elastomeric finger grip insert secured to an index finger portion thereof;

each said first and said second resilient elastomeric finger grip insert including a moisture vent opening to assist in removing moisture accumulation between a wearer's finger tips;

said fabric glove shell including insert receiving ends formed into said thumb and said index finger portion;

each of said resilient elastomeric finger grip inserts including a lower coin contact area for receiving a tip of a user's finger, a U-shaped glove finger top attachment portion formed integrally with and adjacent to a perimeter edge of said lower coin contact area, a glove finger attachment edge, and a contact area biasing strip integrally formed between two parallel portions of said U-shaped glove finger top attachment portion said moisture vent opening being defined by said contact area biasing strip and said U-shaped glove finger top attachment portion; and each of said insert receiving ends of said glove shell including a finger covering portion terminating in a tubular end opening sized for receiving said glove finger attachment edge of said resilient elastomeric finger grip insert therein and a finger top attachment tab extending from and formed integrally with a top of said finger covering portion;

said finger top attachment tab being sized to fit over said U-shaped glove finger top attachment portion and in registration with said perimeter edge of said lower coin contact area of said resilient elastomeric finger grip insert.

3. A glove with finger grip inserts comprising:

a fabric glove shell having an elastic wrist band and insert receiving ends formed into thumb and index finger portions thereof; and two resilient elastomeric finger grip inserts one secured to each of said insert receiving ends of said thumb and index finger portions of said glove shell;

each of said resilient elastomeric finger grip inserts including a lower coin contact area for receiving a tip of a user's finger, a U-shaped glove finger top attachment portion formed integrally with and adjacent to a perimeter edge of said lower coin contact area, a glove finger attachment edge, a contact area biasing strip integrally formed between two parallel portions of said U-shaped glove finger top attachment portion, and a moisture vent opening defined by said contact area biasing strip and said U-shaped glove finger top attachment portion;

each of said insert receiving ends of said glove shell including a finger covering portion terminating in a tubular end opening sized for receiving a said glove finger attachment edge of one of said resilient elastomeric finger grip inserts therein and a finger top attachment tab extending from and formed integrally with a top of said finger covering portion;

said finger top attachment tab being sized to fit over said U-shaped glove finger top attachment portion and in registration with said perimeter edge of said lower coin contact area of said resilient elastomeric finger grip insert.

* * * * *